United States Patent [19]

Fischer

[11] 4,035,977

[45] July 19, 1977

[54] STRUCTURAL ELEMENT

[76] Inventor: Artur Fischer, Gde. Waldachtal, Weinhalde 34, D-7241 Tumlingen, Germany

[21] Appl. No.: 651,398

[22] Filed: Jan. 22, 1976

[30] Foreign Application Priority Data

Jan. 25, 1975 Germany ..... 2502989

[51] Int. Cl.[2] ..... E04C 1/10; A63H 33/08

[52] U.S. Cl. ..... 52/586; 46/25; 52/591

[58] Field of Search ..... 52/582, 585, 586, 587–595; 46/19, 24, 25, 26

[56] References Cited

U.S. PATENT DOCUMENTS

| | | | |
|---|---|---|---|
| 3,076,286 | 2/1963 | Czecholinski | 46/26 X |
| 3,305,982 | 2/1967 | Steele | 46/25 X |
| 3,456,413 | 7/1969 | Fischer | 46/25 X |
| 3,676,918 | 7/1972 | Fischer | 46/25 X |

FOREIGN PATENT DOCUMENTS

| | | | |
|---|---|---|---|
| 1,570,606 | 6/1969 | France | 52/586 |

*Primary Examiner*—J. Karl Bell
*Attorney, Agent, or Firm*—Michael J. Striker

[57] ABSTRACT

A structural element includes a body having a square or rectangular cross-sectional configuration. The body, which has four sides and a pair of oppositely directed lateral or end faces, is provided with connecting means which enables a pair of structural elements to be connected with one another. The connecting means includes undercut grooves and a groove of this type is provided in each of the sides of the body and in one of the lateral faces thereof. The connecting means further includes an undercut lug which is provided at the other lateral face of the body. The lug and grooves are configurated such that the lug of one structural element can be slidably received in the grooves of another structural element thereby joining the elements. The connecting means also includes a pair of slots and one slot is provided in the vicinity of each lateral face of the body. The slots are open at the outer circumferential surface of the body and also at the respective lateral faces of the body. The slots are adapted to receive keys when a pair of structural elements are brought into engagement. The wedging of the keys into the slots provides for a firmer engagement of the structural elements. In this manner, it is possible to compensate for tolerance variations.

9 Claims, 1 Drawing Figure

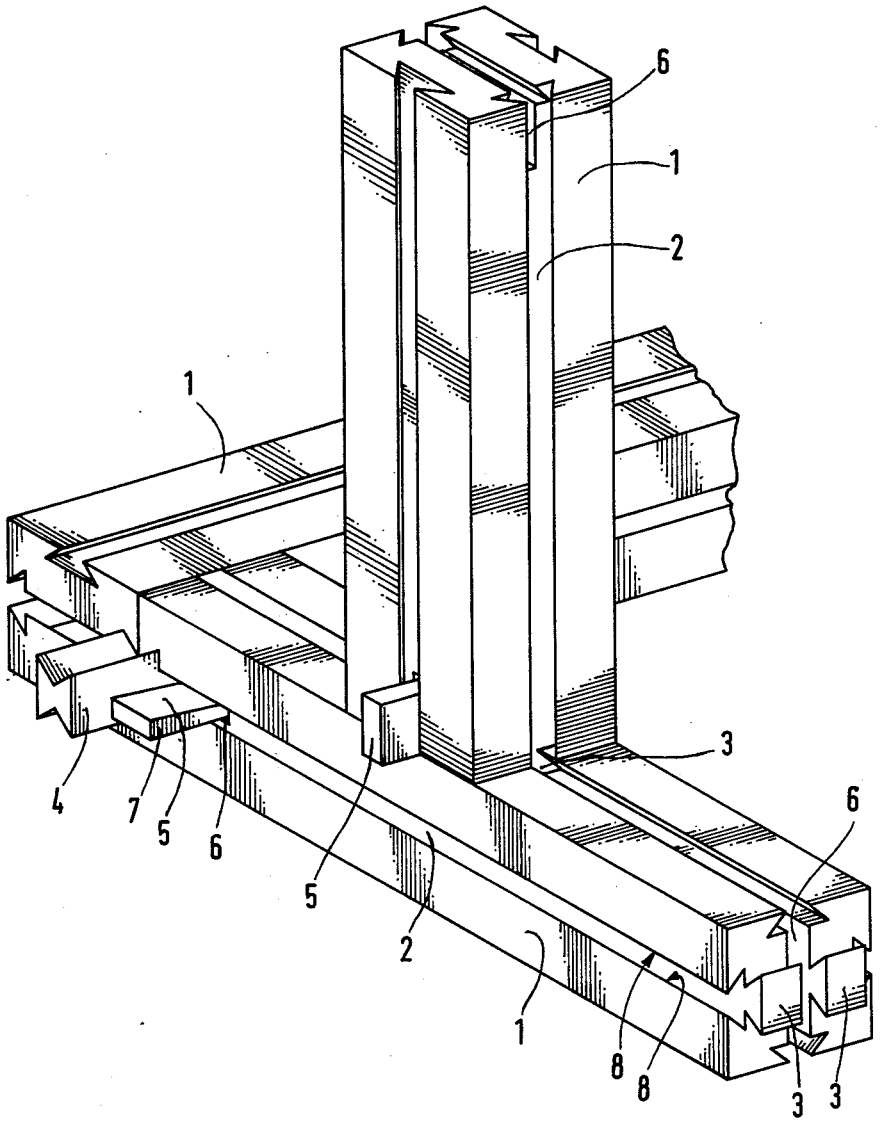
6
1
2
1
3
6
4
7
5
6
5
2
1
8
8
3
3

STRUCTURAL ELEMENT

BACKGROUND OF THE INVENTION

The invention relates generally to structural elements of the type which are provided with means for connecting them to other structural elements. Of particular interest to the invention are structural elements which are useful for the construction of lattice or grid structures, and especially those structural elements which may be used for the production of toy building models.

A known structural element of the type under consideration has a square or rectangular cross-sectional configuration. The sides of the element, as well as one of the lateral or end faces, are provided with undercut connecting grooves. The other lateral face of the element is provided with an undercut connecting lug. The lug may be received on a groove of another structural element and, in this manner, the structural elements may be joined to one another.

Structural elements of this type composed of synthetic resin have been used as building blocks in toy construction sets. The building blocks are connected by pushing the undercut lug into the undercut grooves provided on the sides and one lateral face of each of the building blocks. The adjustment of the force required for sliding the undercut lug into the undercut grooves, as well as the force with which the undercut lug is held in the undercut grooves, makes it necessary to maintain very tight tolerances for the connecting elements (the grooves and lugs) during finishing of the building blocks. For this reason, it is also not possible to make the building blocks arbitrarily large as might be desired, for example, for the erection of toy building models in dependence upon the size of the children. Advantageously, building blocks of larger size, such as those used for toy building models suited for larger children, are made of wood. However, even if one were able to achieve the above-mentioned very tight tolerances during finishing of the building blocks by expending a great deal of effort for the finishing operation and, concomitantly, greatly increasing the costs, it would nevertheless be of little value due to the warping and swelling characteristics of the wood. In fact, even with a change in atmospheric conditions, the dimensions of the connecting elements provided on the building blocks can change in such a manner that a usable connection between two building blocks can no longer be obtained.

SUMMARY OF THE INVENTION

Accordingly, one object of the invention is to provide structural elements which may be readily joined with one another.

Another object of the invention is to provide structural elements, particularly for the production of toy building models, of the type outlined above but having undercut connecting means which may be easily slid into one another and which may be fastened at any desired location using simple means.

These objects, as well as others which will become apparent as the description proceeds, are achieved in accordance with the invention. One aspect of the invention provides a structural element, particularly for the construction of lattice or grid structures and especially for the production of toy building models, which comprises a body having an outer circumferential surface and a pair of spaced end portions. Connecting means is provided for the body for connecting a pair of structural elements with one another. The connecting means includes at least one projection provided at one of the end portions of the body and at least one groove formed in the outer circumferential surface of the body and adapted to receive a projection similar to the above-mentioned projection. The connecting means further includes at least one slot in the body which is open at the outer circumferential surface and at an end portion thereof and which extends along a portion of the body. The slot is adapted to receive a key when a pair of structural elements is brought into engagement so as to compensate for tolerance variations and permit firm engagement of the structural elements to be achieved.

Of particular interest to the invention is a structural element having a generally quadrangular, e.g. square or rectangular, cross-sectional configuration and provided with connecting means which includes an undercut connecting groove in each of the four sides and in one of the lateral or end faces of the structural element and which further includes an undercut connecting lug or projection at the other lateral or end face of the structural element. According to the invention, the stated objects are achieved in that the structural element is provided with a slot in each of the two lateral or end faces thereof. The slots permit keys, e.g. wedges, to be driven in after the joining of two structural elements. The slots extend from the respective connecting elements, that is, the undercut groove and undercut lug, provided at the lateral faces of the structural element and stretch over a portion of the length of the structural element.

After the establishment of a connection between two structural elements by causing the undercut connecting lug of one structural element to slide into an undercut connecting groove of the other structural element, a key is driven into the appropriate one of the slots provided in the regions of the lateral faces of the structural elements. Advantageously, the key is made of wood. Due to driving in of the key, the two structural elements are pushed away from one another and the connecting lug is thereby stressed in the undercut groove. There is thus obtained a firm clamping engagement between the two structural elements which may be loosened at any time by driving out the key.

Due to the possibility provided by the invention of fastening or wedging the structural elements after joining the latter, the connecting elements, that is, the connecting grooves and connecting lugs, may be proportioned relative to one another within very wide tolerances and in such a manner that easy sliding is still assured even if an eventual swelling of these connecting elements occurs.

In order to erect, for example, a toy building model, the structural elements are now joined in accordance with any desired lattice or grid pattern which is adjusted to the particular requirements or needs which exist and are fastened or wedged to one another in the region of the connecting elements, that is, the grooves and lugs. By a suitable arrangement of the structural elements, it is already possible here to provide the openings for doors, windows or the like. Subsequently, the outer and/or inner sides of the building framework are lined by means of plates and the building model is thereby finished.

According to one embodiment of the invention, the width of the slots may correspond to the width of the undercut grooves in the region of the edges or lips of the grooves, that is, the width of the slots may correspond to the spacing between the edges of the grooves. The slots then coincide with the longitudinal grooves of the structural elements without, however, thereby affecting the function of the longitudinal grooves as connecting elements. By virtue of this measure, the slots are hardly recognizable, particularly when the lengths of the keys which are driven in are adjusted so as to correspond to the dimension of the solid crosspiece or web joining two mutually opposite longitudinal grooves.

According to a further embodiment of the invention, the slot that lateral face which is provided with the connecting lug may extend transversely to the connecting lug whereas the slot at that lateral face which is provided with an undercut groove may extend in the same direction as the undercut groove. In this manner, it becomes possible to avoid a mutual alignment of these two types of slots when two structural elements are connected with their lateral faces positioned opposite one another and, accordingly, the necessity for an oversize, that is, an excessively wide, key for fastening or wedging the two structural elements may also be avoided.

According to another embodiment of the invention, when two structural elements are arranged so that two connecting grooves thereof coincide, the structural elements may be joined to one another by means of a joining or connecting member formed by two connecting lugs which are connected with one another. More generally, the connecting member may have a configuration corresponding to a pair of connecting lugs placed back-to-back. The connecting member may also be fastened or wedged in the undercut grooves of the structural elements.

The novel features which are considered as characteristic are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

The single FIGURE illustrates a plurality of structural elements according to the invention and shows some ways in which they may be joined to one another.

DESCRIPTION OF THE PREFERRED EMBODIMENTS

The sole FIGURE shows a plurality of structural elements in accordance with the invention and the structural elements are identified by the reference numberal 1. In the illustrated embodiment, the structural elements 1 are elongated and are of generally quadrangular cross-sectional configuration. Although the structural elements 1 are here shown as being of a generally rectangular cross-sectional configuration, it will be understood that they could, for example, be of a generally square cross-sectional configuration.

Each of the structural elements 1 is provided with undercut grooves 2 in its four major surfaces, that is, its four sides, and is further provided with an undercut groove in one of its two minor surfaces, that is, one of its lateral or edge faces. On the other lateral face, each of the structural elements 1 is provided with an undercut connecting lug or projection 3.

It will be seen that the FIG. illustrates some ways in which the structural elements 1 may be joined to one another. On the one hand, a joining of two of the structural elements 1 may be effected by sliding an undercut connecting lug 3 provided at a lateral face of one of the structural elements 1 into an undercut groove 2 of the other structural element 1. On the other hand, where two of the structural elements 1 are arranged in mating relationship with an undercut groove 2 of one of the structural elements 1 coinciding with an undercut groove 2 of the other structural element 1, the pair of structural elements 1 may be joined by sliding a joining or connecting member 4 formed by two connecting lugs which are connected with one another into the two coinciding undercut grooves 2 of the structural elements 1. More generally, it may be seen that the connecting member 4 has a configuration corresponding to a pair of the lugs 3 placed back-to-back.

Each of the structural elements 1 is provided with slots 6 at the two lateral faces thereof. The slots 6 extend from the respective connecting elements, that is, the groove 2 and the lug 3, provided at the opposite lateral faces of each of the structural elements 1 and stretch along a portion of the length of the respective structural element 1.

In order to fix or tighten the joints between the structural elements 1, there are provided keys or wedges 5. The thickness of the keys 5 is adjusted to the width of the slots 6. As will be appreciated, the slots 6 here permit the keys 5 to be driven in at the region of the joint so that a fastening or wedging effect, and an accompanying tightening of the joint, may be obtained. It may be seen that the keys 5 are provided with side faces 7 and a fastening or wedging effect may be achieved by making the side faces 7 of the keys 5 of an arcuate or conical configuration.

The width of the slots 6 here corresponds to the width of the undercut grooves 2 in the region of the edges or lips 8 of the grooves 2. In other words, the width of the slots 6 here corresponds to the spacing between the edges 8 of the grooves 2. By virtue of this, the slots 6 disappear in the longitudinal grooves 2 of the structural elements 1, that is, the slots 6 are hardly noticeable. By adjusting the length of the keys 5 so as to correspond to the dimension of the solid crosspieces or webs which remain in the structural elements 1 between two mutually opposite ones of the longitudinal grooves 2, the fastening or wedging of the joints by means of the keys 5 becomes hardly observable.

In the illustrated embodiment, the slot 6 provided at that lateral face of each of of the structural elements 1 which has a connecting lug 3 extends transversely to this connecting lug 3 whereas the slot 6 provided at that lateral face of each of the structural elements 1 which has an undercut groove 2 extends in the same direction as this undercut groove 2. In this manner, it becomes possible to avoid coincidence of a slot 6 provided at a lateral face having a lug 3 with a slot 6 provided at a lateral face having a groove 2 when a pair of the structural elements 1 are joined with a lateral face of one positioned opposite a lateral face of the other. Accordingly, the necessity for an oversize or overly wide key 5 in such an event may be avoided.

It will be appreciated that a structural element in accordance with the invention may be proportioned so as to be suitable for use in the erection of toy building models.

It will be understood that each of the elements described above, or two or more together, may also find a useful application in other types of constructions, differing from the types described above.

While the invention has been illustrated and described as embodied in astructural element for the construction of lattice structures, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapte it for various applications without omitting features that, from the standpoint of prior art, fairly constitute essential characteristics of the generic or specific aspects of this invention.

What is claimed as new and desired to be protected by Letters Patent is set forth in the appended claims:

1. A structural element, particularly for the construction of model structures, comprising a body having a periphery and a pair of spaced end portions; connecting means provided for said body for connecting a pair of structural elements with one another, said connecting means including at least one projection having outer surface portions provided at one of said end portions, and at least one groove having inner surface portions formed in said periphery and adapted to receive a projection similar to said one projection for free sliding movement of said respective surface portions relative to each other; and means for urging said respective surface portions towards each other to thereby arrest said structural elements in a selected position relative to each other, said urging means including at least one slot in said body which is open at said periphery and at an end portion of said body and which extends along a portion of said body, and a key which is adapted to be received in said one slot for displacing said respective surface portions into frictional engagement with each other when a pair of structural elements is brought into engagement, whereby variations in the manufacturing tolerance of the structural element are compensated.

2. An element as defined in claim 1, wherein an additional slot similar to said one slot is provided in said body, said additional slot opening to the end portion of said body which is opposite that to which said one slot opens.

3. An element as defined in claim 2, said body having four sides, and said end portions comprising lateral faces of said body; and wherein a groove similar to said one groove is formed in each of said sides and in the lateral face opposite that which is provided with said one projection, said grooves and said one projection all being formed with an undercut.

4. An element as defined in claim 3, wherein said body has a substantially rectangular cross-sectional configuration.

5. An element as defined in claim 3, wherein said has a substantially square cross-sectional configuration.

6. An element as defined in claim 3, wherein the slot which opens to the lateral face having said one projection extends transversely to said one projection and the slot which opens to the opposite lateral face extends in the same direction as the groove formed in the latter face.

7. An element as defined in claim 3, wherein said grooves are formed in such a manner that, when a pair of structural elements are arranged with a groove of one adjacent a groove of the other, the structural elements are capable of being connected via the adjacent grooves using a joining member which is slidably received in each of the adjacent grooves and which has a configuration corresponding to a pair of projections similar to said one projection placed back-to-back.

8. An element as defined in claim 1, said one groove being formed with an undercut and having a pair of spaced edges at said outer surface; and wherein said one slot opens to said one groove and the width of said slot substantially equals the spacing between said edges.

9. An element as defined in claim 1, wherein said body is adapted for use in the erection of toy building models.

* * * * *